US005765888A

United States Patent [19]

Stack

[11] Patent Number: 5,765,888

[45] Date of Patent: Jun. 16, 1998

[54] REMOVABLE CLIP DEVICE FOR BOTTLE ATTACHMENT

[76] Inventor: Christopher F. Stack, 60 Church Rd., Arnold, Md. 21012

[21] Appl. No.: 669,248

[22] Filed: Jun. 24, 1996

[51] Int. Cl.[6] ..... A45F 5/10; B65D 23/10

[52] U.S. Cl. ..... 294/27.1; 294/166; 215/396; 224/148.4

[58] Field of Search ..... 294/27.1, 31.2, 294/34, 90, 91, 137, 145, 149, 165, 166; 215/396, 397, 399; 224/148.1, 148.4, 148.5, 148.6

[56] References Cited

U.S. PATENT DOCUMENTS

| | | | |
|---|---|---|---|
| D. 286,859 | 11/1986 | Wu | 294/31.2 |
| 1,839,636 | 1/1932 | Baker | 294/27.1 |
| 2,065,803 | 12/1936 | Grenier . | |
| 2,433,037 | 12/1947 | Ferris . | |
| 2,632,666 | 3/1953 | Cunningham . | |
| 2,781,221 | 2/1957 | Pekora . | |
| 3,275,366 | 9/1966 | Hidding . | |
| 3,751,098 | 8/1973 | Owen | 294/87.2 |
| 4,090,729 | 5/1978 | Erickson | 294/31.2 |
| 4,093,295 | 6/1978 | Erickson | 294/87.2 |
| 4,116,374 | 9/1978 | Garello | 224/55 |
| 4,516,687 | 5/1985 | Taguchi et al. | 220/94 R |
| 4,565,397 | 1/1986 | Keen | 294/34 |
| 5,188,413 | 2/1993 | Nathan | 294/87.2 |
| 5,203,481 | 4/1993 | Dobbins et al. | 224/148 |
| 5,255,947 | 10/1993 | Schwartz | 294/31.2 |
| 5,413,261 | 5/1995 | Wu | 224/148 |
| 5,505,353 | 4/1996 | Marsh, Jr. | 224/148.6 |
| 5,577,647 | 11/1996 | Pittarelli et al. | 224/148.6 |

*Primary Examiner*—Dean Kramer
*Attorney, Agent, or Firm*—Corinne R. Gorski

[57] ABSTRACT

A carrying device removably attachable to a beverage bottle or other container. The device includes a first u-shaped base member which is slid over the neck of the bottle. A second closure member is removably fastenable with the base member to encircle the neck of the bottle therebetween. Each of the base and the closure members include a slot for accommodating a carrying strap, handle or the like, for supporting the bottle or container. In another embodiment, the device comprises a pair of symmetrical clips slid over the neck of the bottle in opposing directions to encircle the neck of the bottle therebetween. Each of the clips include a slot for receiving a carrying strap, handle or the like, which both supports the bottle or container and secures the clips together.

4 Claims, 5 Drawing Sheets

REMOVABLE CLIP DEVICE FOR BOTTLE ATTACHMENT

BACKGROUND OF THE INVENTION

1. Field of the Invention

The present invention relates to a carrying device removably attached to a beverage bottle or other container for supporting the same, and more particularly, to a device for removably attaching carrying straps, handles or the like to a bottle or container.

2. Description of the Related Art

People often participate in activities, such as hiking, which require carrying a beverage or water container for personal consumption. Historically, a canteen has been used for this purpose. Recently, however, commercially available bottles of drinking water have appeared on the market. Although convenient and sanitary, these known blow molded polymer beverage containers are cumbersome to carry without a bag, backpack or other holder.

The blow molded containers currently on the market come in a variety of sizes and shapes. However, most of these containers include a standard size flanged neck. It seems appropriate that for maximum versatility a bottle holder should use this portion of the bottle for fastening. Thus, there is a need for a simple device for carrying a container.

It is known to use removable means attachable to a container to support and carry the same. However, these known carriers are complex, often including a plurality of parts which could become lost. Another disadvantage with the prior art carriers is the high costs associated with manufacturing.

U.S. Pat. No. 5,203,481 discloses a caddy which is attached to a squeeze bottle or container. One disadvantage with such a caddy is that in order for the device to be used with conventional bottles, the device must be secured on the upper surface of the neck portion, i.e., between the flange and cap of the bottle. Thus, the cap must be removed before attaching the caddy to a conventional bottle, with the cap holding the caddy in place on the bottle. Thus, if a user wishes to drink from a non-squeeze type bottle, the user must risk having the caddy disengage from the bottle once the cap is removed. Another disadvantage with such a device is that the user is limited to a small range of bottle sizes or container shapes. Moreover, it appears that means for securely fastening the carrying straps or like to the caddy are not provided. Oppositely, portions of the caddy are designed to break away to free the carrying strap therefrom.

Thus, there is the need for a carrying device that can be simply attached and removed from a variety of bottle styles and sizes, including means for attaching a suspending strap or the like for hands free support thereof.

SUMMARY OF THE INVENTION

An object of the present invention is to provide an easy to use, removable carrying device for attaching carrying straps, handles or other supports to a beverage bottle or other container.

Another object of the present invention is to provide a carrying device which encircles the neck of a container and is closable by a removable closure. Handles, straps or other supports are attached directly to the device.

A further object of the present invention is to provide a carrying device which is simple to produce, thus reducing manufacturing costs.

Still another object of the present invention is to provide a simple carrying device which encircles the neck of the bottle and includes an integral handle, strap or other support which secures the devices as well as providing means for supporting the bottle and carrying device assembly.

In accomplishing these and other objectives of the present invention, there is provided a carrying device removably attachable to a beverage bottle or other container, comprising a first means for engaging a portion of the bottle. Second means is removably fastenable with the first engaging means. Means fasten the first and second means together and means are attachable to the first and second means for supporting the bottle.

The first means comprise a base member having a pair of legs, which upon attachment engage a neck of the bottle therebetween. The second means comprises a closure member removably fastenable with the base member.

The fastening means comprise a catch disposed on each of the legs of the base member. Each of the legs are removably received within a respective channel of the closure member and each catch locks the leg within the respective channel.

The supporting means comprises an elongated strap attachable to both the base and closure members.

Other features and advantages of the present invention will become apparent from the following description of the invention which refers to the accompanying drawings.

DETAILED DESCRIPTION OF THE PREFERRED EMBODIMENTS

Figure 1:
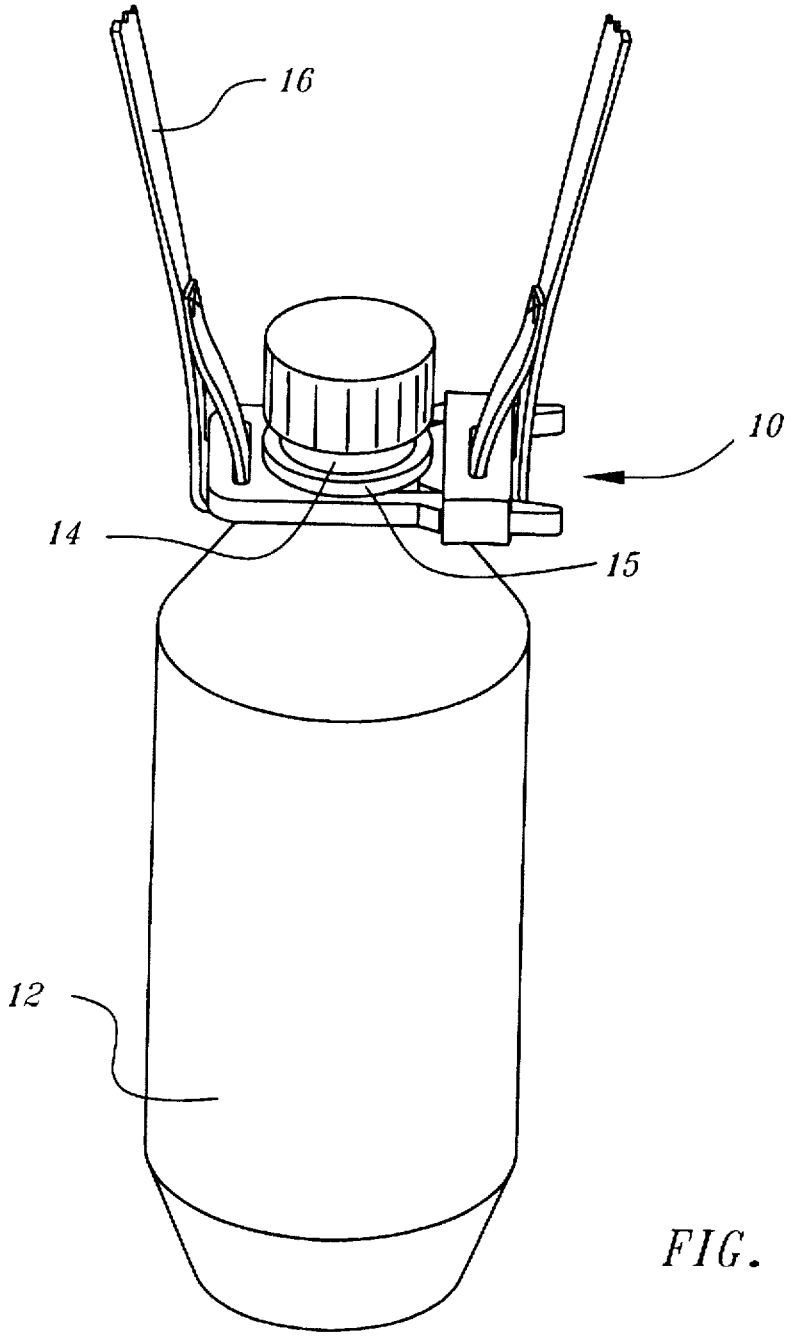
FIG. 1 is a perspective view of one embodiment of the carrying device of the present invention.
Figure 2:
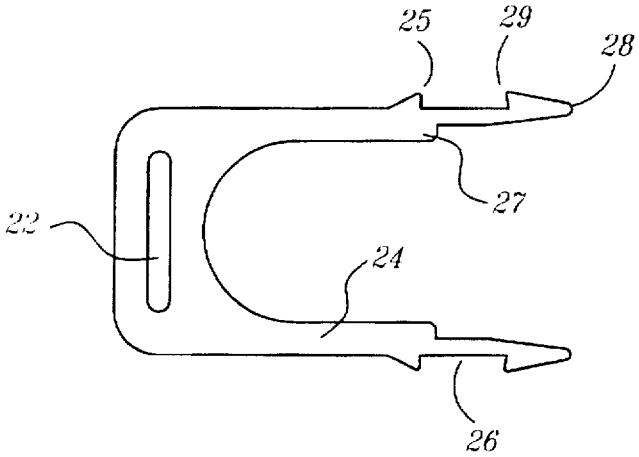
FIG. 2 is a top view of a base member of the first embodiment of FIG. 1.

Referring to FIG. 1, the carrying device of the present invention comprises a clip 10 which is removably attached to a neck 14 of a bottle 12. Clip 10 includes a strap 16 attached thereto for supporting the bottle.

As shown in FIGS. 1–5, clip 10 includes a base 20 and a closure 30. Base 20 may be U-shaped and includes a slot 22 for attaching strap 16 thereto. It should be appreciated that other known attachment means can be used to attach the strap to the clip. Base 20 also includes a pair of legs 24. Each of the legs 24 include a stop 25, a hollow portion 26 which engages in closure piece 30, which will be described further herein, and a flexible end 28 which includes a catch 29. Legs 24 also each include a shelf 27. Shelf 27 keeps catch 29 from becoming disengaged from closure piece 30 by forcing the legs 24 and closure 30 to flex together if force is applied.

Figure 3:
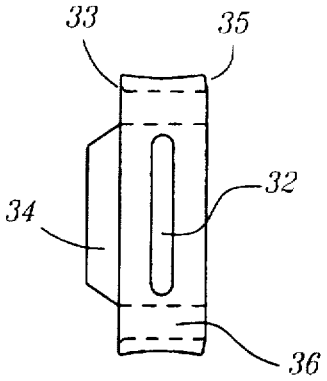
FIG. 3 is a top view of the closure member of the embodiment of FIG. 1.

Referring to FIG. 3, closure 30 includes a slot 32 for accommodating strap 16. Disposed on either side of slot 32 are channels 36 which extend through the width of closure 30. Channels 36 receive ends 28 of legs 24 of base 20. Closure 30 also includes a shoulder 34 which abuts against bottle neck 14 when the device is assembled on the bottle.

Figure 4A:
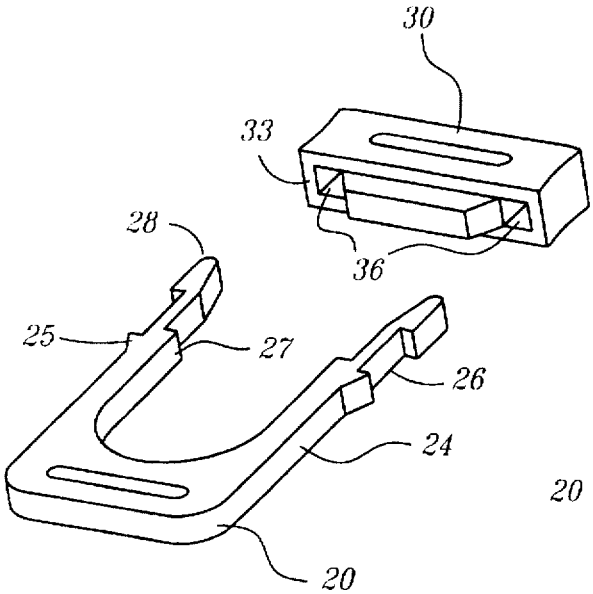
FIGS. 4A and 4B are perspective view of the assembly of the carrying device of the embodiment of FIG. 1.

In operation, base 20 is slid over the bottle neck beneath a flange 15 of the bottle, see FIG. 1. Legs 24 surround the bottle neck. As illustrated in FIGS. 4A–5, ends 28 of base 20 are slid into channels 36 of closure 30. As shown in FIG. 5, upon insertion of legs 24 within closure 30, each stop 25 abuts an edge 33 of closure 30, and catch 29 engages an edge 35 to secure base 20 within closure 30. Thus, the two pieces will move together under strain and no unintentional release will occur if the clip is twisted or bent.

Figure 4B:
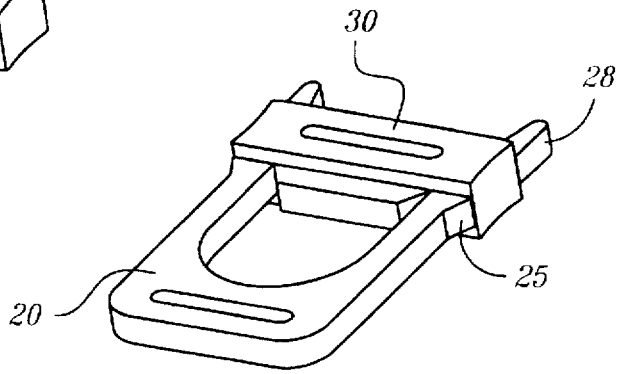
Figure 5:
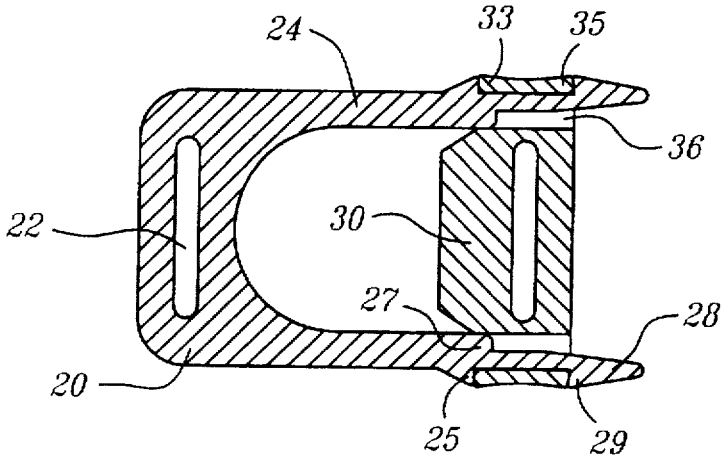
FIG. 5 is a cross-sectional view of the assembled base and closure members of the embodiment of FIG. 1.

As shown in FIGS. 4B and 5, when assembled, ends 28 extend beyond closure 30. The clip may be removed from the bottle by squeezing ends 28 together. This releases the catches 29 of base 20 from closure 30 allowing the two pieces to be slid apart.

Figure 6C:
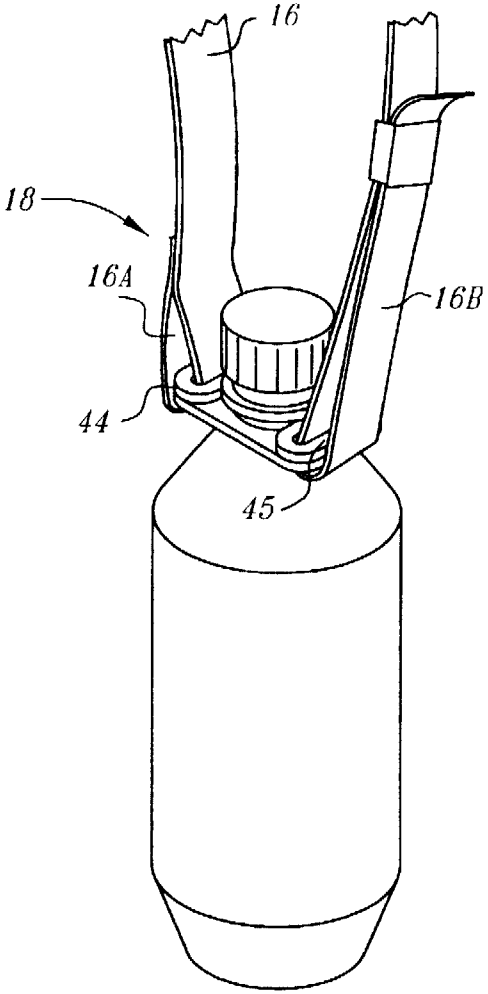
FIGS. 6A–6C are perspective views of a second embodiment of the carrying device of the present invention.
Figure 6B:
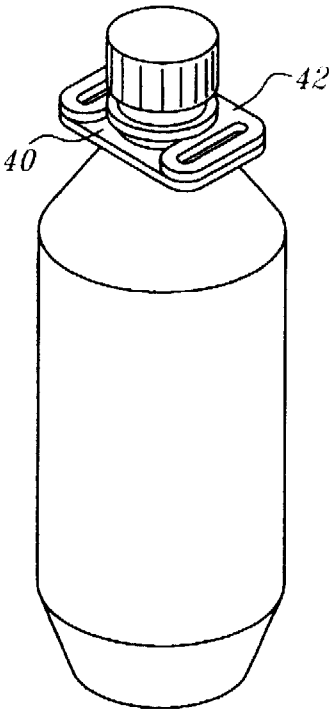
Figure 6A:
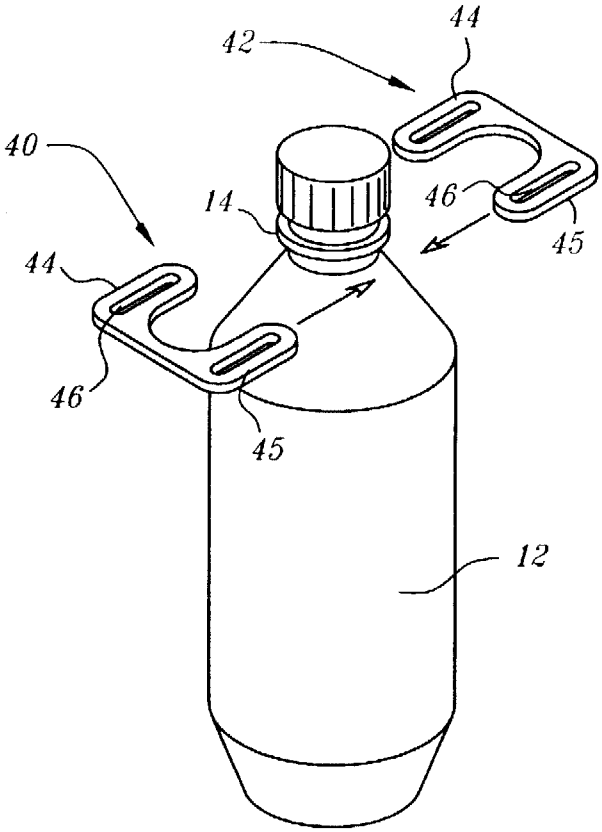
Figure 7:
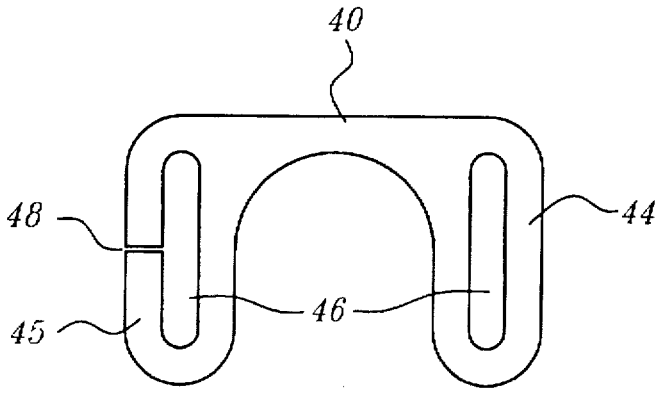
FIG. 7 is a top view of one of the identical clips of the second embodiment of the present invention.

Referring to FIGS. 6A–7, another embodiment of the invention comprises a carrying device made of two opposing symmetrical clips 40, 42. Clips 40, 42 can be molded or stamped from, for example, a plastic material, such as nylon, or a metal. It should be appreciated that the invention can be formed from a variety of materials and is not limited to the materials mentioned above.

Since clips 40, 42 are symmetrical, for simplicity only a single part will be described herein. As shown in FIGS. 6A and 7, clip 40 may be a flat U-shaped piece having legs 44, 45. Each of the legs 44, 45 includes a slot 46 for receiving an end of strap 16 or for attaching a handle or other equivalent support, which will be described further herein. Clip 40 encircles the neck 14 of the bottle, with the center of the clip being sized to snugly receive the bottle neck between legs 44, 45.

Referring to FIGS. 6B and 6C, clips 40, 42 are slid in an opposed manner under the flanged neck 14, one on top of the other, so that the two clips completely enclose the bottle neck. In this assembled position, the slots 46 of each of the legs 44, 45 are aligned. Although not shown in FIGS. 6A and 6B, prior to assembly of the clips 40, 42 on the bottle neck, one end 16A of the strap 16 can be threaded through the slots of a pair of aligned legs 44 and permanently sewn together at 18, as shown in FIG. 6C. When the clips are assembled on the bottle free end 16B of the strap can be threaded through aligned slots 46 of legs 45 and attached together by a clamp 17, shown in FIG. 6C.

When it is time to remove the clips 40, 42 from bottle 12, clamp 17 is loosened, end 16B of the strap is separated from the slots and clips 40, 42 slid from the bottle neck. The attached end 16A has enough play to allow the clips to be adjusted in relation to each other to remove the same from the bottle. Thus, allowing removal of the device by detachment of only one end of the strap or other equivalent attachment means.

As shown in FIG. 7, one of the legs 45 of the clips can include a split portion 48 for aiding insertion of strap free end 16B. Thus, the two clips 40, 42 are held securely in place around the bottle neck by strap 16. It should be appreciated that another form of attachment means for securing clips 40, 42 can be provided, with strap 16 being used to solely support the clip and bottle assembly.

Figure 8:
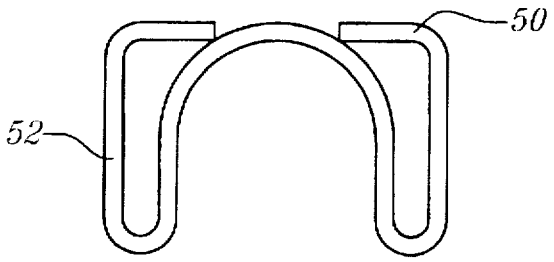
FIG. 8 is a top view of a third embodiment of a carrying device of the present invention.

Referring to FIG. 8, another embodiment of the present invention will be described. In this embodiment, the clip comprises a bent wire 50 shaped to include slots 52 for accommodating attachment means. The embodiment of FIG. 8 operates in the same manner as the embodiment of FIGS. 6A–7. Thus, two wire clips 50 are slid over the bottle neck in an opposed manner to encircle the bottle neck therebetween. Wire clip 50 can be made from for example a steel wire having a gauge of 12. Once again, the invention is not limited to any particular wire material or size.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A carrying device removably attachable to a beverage bottle or other container, comprising:

first means for engaging a portion of the bottle, said first engaging means having a base member including a pair of legs, wherein upon attachment, a neck of the bottle is engaged between said pair of legs;

second means removably fastenable with said first engaging means, said second means including a closure member removably fastenable with said base member;

means for fastening said first and second means together, said fastening means including a catch disposed on each of said legs of said base member, each of said legs being removable received within a respective channel of said closure member, wherein each of said legs are slid into said respective channel and each catch locks said leg within the respective channel of said closure member; and means attachable to said first and second means for supporting the bottle.

2. The carrying device of claim 1, wherein said supporting means comprises an elongated strap attachable to said base and closure members.

3. The carrying device of claim 2, wherein said base member and said closure member each include a slot for receiving an end of said elongated strap.

4. A method for assembling a carrying device on a beverage bottle or container, comprising the steps of:

sliding a base member over a portion of the container, said base member including a pair of legs for encircling the portion of the container therebetween;

sliding a closure member over the legs of said base member, said closure member including a pair of channels for receiving said pair of legs;

fastening said closure member with said base member, said legs of said base member each including means for engaging said closure member; and attaching a support means to each of said base and closure members for supporting the container.

* * * * *